United States Patent [19]

Martin et al.

[11] 4,308,904

[45] Jan. 5, 1982

[54] COLLAPSIBLE SOLUTION CONTAINER HAVING REDUCED COLLAPSE RATE AT THE END OF THE COLLAPSING PROCESS

[75] Inventors: Jerry D. Martin, Highland Park; Stephen J. Pearson, Ingleside; Gary A. Ward, Round Lake, all of Ill.; David A. Winchell, Twin Lakes, Wis.

[73] Assignee: Baxter Travenol Laboratories, Inc., Deerfield, Ill.

[21] Appl. No.: 126,228

[22] Filed: Mar. 3, 1980

Related U.S. Application Data

[63] Continuation-in-part of Ser. No. 28,151, Apr. 9, 1979, Pat. No. 4,232,721.

[51] Int. Cl.[3] ..... B65D 1/02

[52] U.S. Cl. ..... 150/0.5; 222/107

[58] Field of Search ..... 150/0.5; 222/107; 128/214 D, DIG. 24

[56] References Cited

U.S. PATENT DOCUMENTS

| | | | |
|---|---|---|---|
| 2,896,619 | 7/1959 | Bellamy | 128/DIG. 24 |
| 3,081,002 | 3/1963 | Tauschinski | 150/0.5 X |
| 3,595,441 | 7/1971 | Grosjean | 150/0.5 X |
| 3,641,999 | 2/1972 | Greene | 128/DIG. 24 X |
| 3,921,630 | 11/1975 | McPhee | 222/107 X |
| 4,049,033 | 9/1977 | Ralston | 150/0.5 |
| 4,088,166 | 5/1978 | Miller | 150/0.5 |

*Primary Examiner*—Donald F. Norton

*Attorney, Agent, or Firm*—Paul C. Flattery; John P. Kirby, Jr.; Garrettson Ellis

[57] ABSTRACT

A molded collapsible solution container defines a chamber-defining body portion wall having an integral neck portion and a shoulder portion at one end thereof. The container defines a pair of opposed gusset portions adjacent the shoulder portion at opposite ends of the shoulder portion, with the shoulder portion defining opposed shoulder edges extending between the gusset portions. A pair of opposed lines of flexing weakness are defined in the collapsible solution container and exhibit an arcuate cross section which extends inwardly of the container. The opposed lines of flexing weakness are positioned on each side of the container in generally parallel relation to the opposed shoulder edges with the opposed lines of flexing weakness being longitudinally spaced from the shoulder edges by a distance which is proportioned to cause the opposed lines of flexing weakness to abut one another as the container collapses inwardly about the opposed shoulder edges. Accordingly, the abutting lines of flexing weakness inhibit further collapse of the container under the pressure of suction, to slow the rate of subsequent collapse.

9 Claims, 9 Drawing Figures

FIG. 1
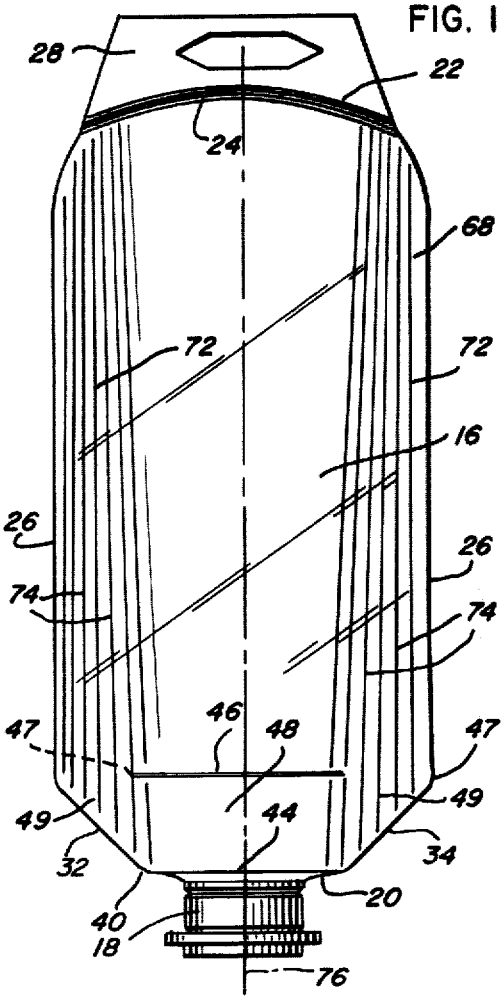
FIG. 3
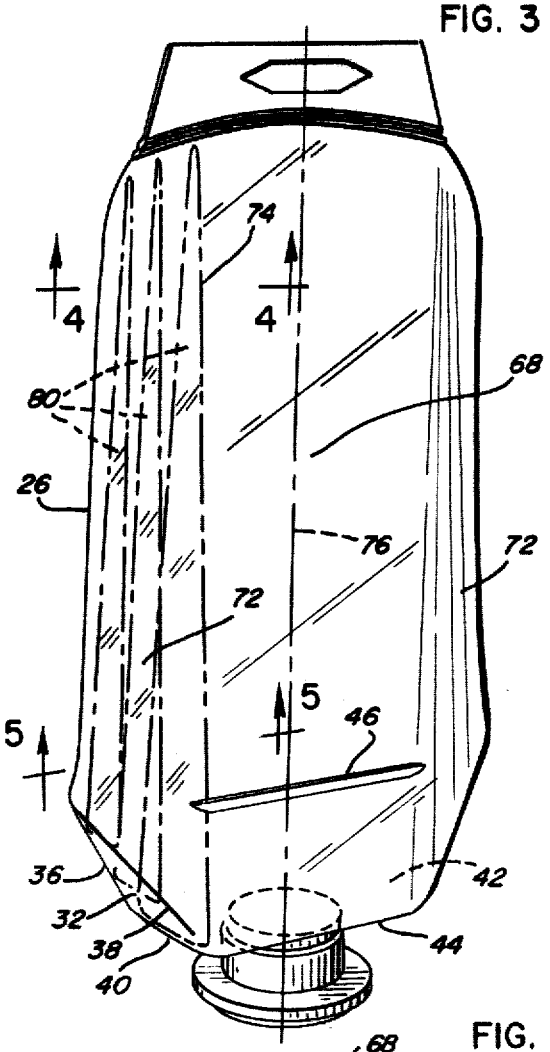
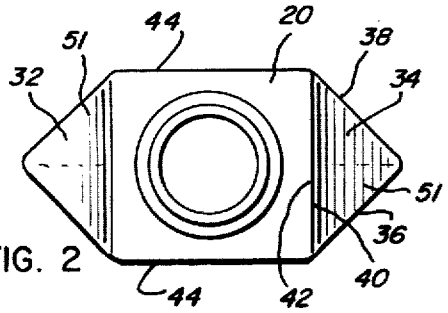
FIG. 2
FIG. 4
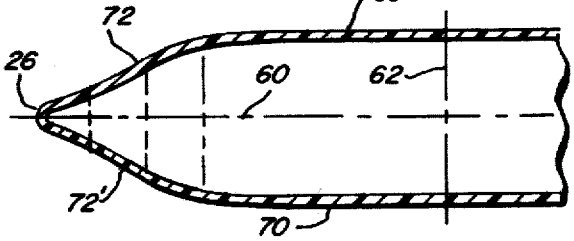
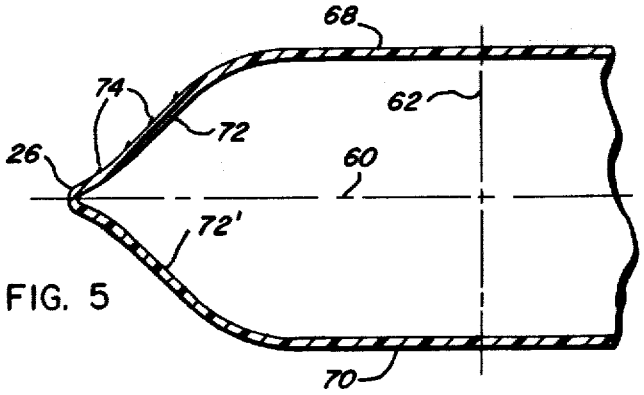
FIG. 5

COLLAPSIBLE SOLUTION CONTAINER HAVING REDUCED COLLAPSE RATE AT THE END OF THE COLLAPSING PROCESS

CROSS-REFERENCE TO RELATED APPLICATION

This application is a continuation-in-part of prior pending application Ser. No. 028,151, filed Apr. 9, 1979, now U.S. Pat. No. 4,232,721 and entitled "Collapsible Solution Container Having Rectilinear Shoulder".

BACKGROUND OF THE INVENTION

In U.S. Pat. Nos. 4,049,033 and 4,088,166, among others, a molded collapsible solution container is disclosed which collapses relatively easily under low suction pressures, and thus finds particularly desirable use as a container for parenteral solutions.

It is particularly desirable for the collapsibility of the container to be as complete as possible at the low suction pressures generated by, for example, a two to three foot suction head of water or a desired parenteral solution, even when the container is made of a relatively stiff polyolefin plastic or the like which customarily has not been thought of being useful for making a container which completely collapses under such a low suction pressure head.

In parenteral solution administration, if flow of solution through the needle residing in the vein of a patient terminates, the needle will fill with clotted blood in a short period of time.

In accordance with this invention, as a specific, useful characteristic of the container of this invention, when it is collapsed to its almost completely empty configuration, the rate of draining of the container at a constant suction pressure head decreases substantially, but does not completely terminate, for a significant period of time. Accordingly, the container may be designed for parenteral solution therapy with a 1,000 ml. or other desired dosage capacity, but optionally also with a small amount (for example 50 ml.) of extra capacity of parenteral solution). Accordingly, the container of this invention can be designed so that about 900 ml. or more of parenteral solution can be administered normally, but in the event that the nurse does not arrive at the time of termination of the administration of the 900 ml., the administration flow does not altogether cease, but merely slows down for the last 150 ml. or so, with the result that clotting of the needle is prevented, as takes place when no flow is passing through the administration set. At the same time, because of the reduced flow following the administration of the basic amount of solution, there is no serious overdose of the patient.

DESCRIPTION OF THE INVENTION

In accordance with this invention, a molded, collapsible solution container defining a chamber-defining body portion wall has an integral neck portion and a shoulder portion at one end thereof. The container may also define, if desired, a pair of opposed gusset portions adjacent the shoulder portion and at opposite ends of the shoulder portion. The shoulder portion defines opposed shoulder edges extending between the gusset portions, when present, and a pair of opposed lines of flexing weakness defined in the collapsible solution container and exhibiting an arcuate cross section which extends inwardly of the container.

The opposed lines of flexing weakness are positioned on each side of the container in generally parallel relation to the opposed shoulder edges. The opposed lines of flexing weakness are longitudinally spaced from the shoulder edges by a distance which is proportioned to cause the opposed lines of flexing weakness to enter into abutting relationship with one another as the container collapses inwardly about the opposed shoulder edges.

As the result of this, the abutting lines of flexing weakness inhibit further collapse of the container under the pressure of suction, to slow the rate of subsequent collapse.

Accordingly, the container may be used as a container for parenteral solution, being hung on an IV pole in conventional manner and communicating through a parenteral solution administration set and an IV needle to the venous system of a patient. As the container collapses, for example in a manner similar to that described in the previously cited application Ser. No. 028,151 and the previously cited U.S. patents, the walls rotate inwardly about the opposed shoulder edges until the opposed lines of flexing weakness enter into their abutting relationship. Following this, the container is capable of further collapse, but, due to the resistance provided by the abutting lines of flexing weakness, the rate of collapse at an essentially unchanged suction head imparted by parenteral solution in the set below the container is substantially reduced, providing the desired effect of reduced but positive liquid flow out of the container, as described above.

The distance between each opposed shoulder edge and the respective lines of flexing weakness must be more than one half of the distance between the opposed shoulder edges, so that it is possible for the lines of flexing weakness to enter into abutting relationship as the container collapses. Preferably, the distance between each opposed shoulder edge and its associated line of flexing weakness should be less than the spacing between the opposed shoulder edges. Typically, the spacing is substantially less, for example, no more than 60 percent of the spacing between the opposed shoulder edges.

The container also preferably defines a pair of opposed gusset portions adjacent the shoulder portion at opposite ends of the shoulder portion and tapering outwardly from the shoulder portion. The shoulder portion and gusset portions together preferably define an elongated shape in cross section having a major cross sectional axis.

As shown herein, the shoulder portion may be rectangular in shape, with the wall circumferences of the transverse, cross sections of the body portion progressively decreasing in length along the shoulder from adjacent the shoulder portion toward the opposite end. It is preferred for the opposite end of the container to taper from the shoulder portions progressively along a major portion of its length to a flat, sealed end portion.

The flattened container can exhibit an outward flaring from the flat tail end to the shoulder end. The structure facilitates the collapse of the container, providing room for the gusset portion to pivot outwardly to achieve an improved mode of collapse.

The preferred gusset portions may be positioned in opposed relation to each other, and made to define three sides in triangular relation, one of the sides of each of the gusset portions being generally parallel to the opposed shoulder edges adjacent which the gussets are positioned.

Preferably, the side of each gusset portion which is parallel to the shoulder edge is positioned directly on the shoulder edge, to constitute a common member with the shoulder edge. Alternatively, the parallel side of the gusset portion may be recessed under the shoulder edge as shown, for example, in U.S. Pat. No. 4,088,166.

The rectangular shoulder portion also defines a second pair of opposed shoulder edges which are in generally normal relation to the opposed shoulder edges that are parallel to the opposed gusset portions.

Preferably, each of the second shoulder edges and the parallel lines of weakness define respective areas between them in the container wall which are essentially planar in their original, unstressed condition.

Preferably, the container of this application defines a convex, arcuate seal line adjacent its flat, sealed end for improved strength.

It is also preferable for the transverse cross-sections of the container along the majority of its length, beginning adjacent the shoulder portion, to exhibit mutually perpendicular major and minor transverse axes with the major axes being longer than the minor axes. A pair of opposed, outwardly-angled wall portions, each defining a generally acutely-angled apex, may be positioned on the major axes.

Furthermore, the same transverse cross-sections may preferably exhibit generally planar central areas adjacent the minor transverse axes.

Preferably, the opposed lines of flexing weakness define a plane which is positioned within one centimeter of the rear apexes of the gussets at their closest point.

Referring to the drawings,

FIG. 1 is an elevational view of the container in its initial, as-molded unstressed configuration.

FIG. 2 is a plan view of the container of FIG. 1 in its initial, unstressed configuration.

FIG. 3 is a perspective view of the container of FIG. 1.

FIG. 4 is a sectional view taken along line 4—4 of FIG. 3.

FIG. 5 is a sectional view taken along line 5—5 of FIG. 3.

Figure 6:
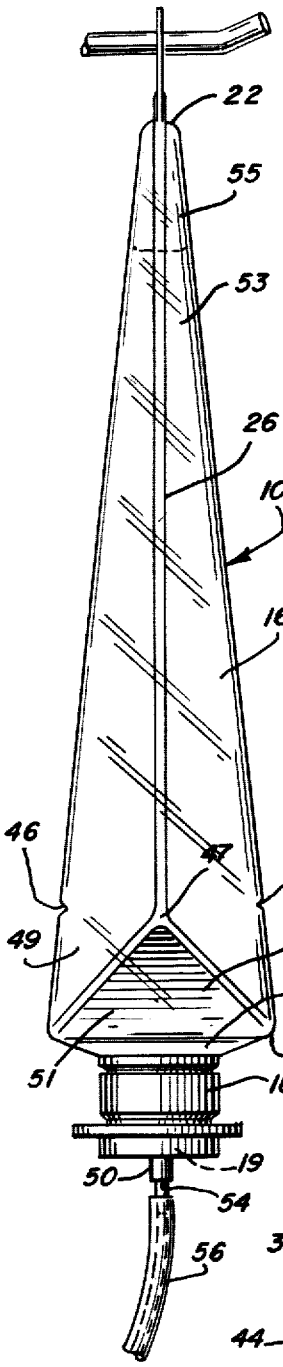
FIG. 6 is an elevational view of the container of FIG. 1, rotated 90° about its longitudinal axis, showing the container being hung and filled with liquid, and being drained of its liquid by an administration set of conventional design.

Referring to the drawings, the molded collapsible solution container 10 is shown to have a chamber-defining body wall portion 16 and an integral neck portion 18 adapted for receiving a conventional, sterile seal closure 19 for parenteral solution containers (FIG. 6) and a shoulder portion 20. Container 10 may be made by a conventional blow molding process for example as shown in U.S. Pat. Nos. 4,076,063 and 4,105,730.

As in the previously cited patents and application, the container may define, in its normal, as-molded, unstressed state, a transverse cross-section which tapers from shoulder portion 20 progressively along a major portion of its length to a flat, sealed end portion 22 at the end of the container opposite to the one end which carries the shoulder portion. Preferably, the tapering begins at the shoulder portion 20 and proceeds in generally continuous manner to the sealed end 22.

The specific design of sealed end 22 may be in accordance with the method and design described in U.S. Pat. Nos. 4,105,730 and/or 4,076,063, or a simple double bar end seal may be used.

End 22 of container 10 further defines a convex, arcuate seal line 24, adjacent to and as part of the flat, sealed end 22. The convex, arcuate configuration of the seal line 24 provides improved strength to the seal, which is particularly desirable as in the specific embodiment involving thin sheets of preferably oriented plastic material, which is generally difficult to seal in a reliable and strong manner.

The wall thickness of the container of this application may preferably be about 0.01 to 0.02 inch in thickness, and is generally uniform about the entire chamber-defining body portion 16 of the container, while the neck portion 18 is typically of greater wall thickness so as to be relatively stiff. Shoulder portion 20 is desirably as thin as body portion 16 about its edges, and is thicker at central portions thereof, for example about 0.03 inch thick.

A thin line of flexing weakness 26 of arcuate cross-section may be defined in opposed relation along the longitudinal edges of the container, as shown in the drawings, to facilitate the flat collapse along the length of the bag.

The flat end 22 defines a flat extension 28 which may be utilized as a hanger member, as shown in FIG. 2, for example.

The shoulder portion 20 may be rectangular in shape. Furthermore, as specifically shown in FIGS. 4 and 5, the various transverse cross-sections of the container exhibit wall circumferences which progressively decrease in length along the container from adjacent the shoulder portion 20 toward the opposite end 22 thereof. Accordingly, the collapsed container exhibits a taper from the shoulder to the other end which has been found to be beneficial in providing a flat, planar collapse, rather than collapsing flat to a generally non-planar, slightly buckled structure, as in the prior art.

This provides a significant advantage of permitting the collapsed bags, prior to filling, to receive printing on the face of the bag itself to function as a label, with volume indicia for indicating the amount of liquid withdrawn from the bag, or any other desired information.

As a further contribution to the planar configuration that most of the bag can occupy, (with the exception of the shoulder and neck portions and end 22) in its collapsed configuration, the bag tapers uniformly from the shoulder end 20 to the tail end 24 without the use of a non-tapered section in body wall portion 16, as has been shown in the prior art.

The collapsible container of this invention may also define gusset portions 32, 34, which facilitate the outward spreading of the container wall adjacent shoulder 20 on the axis between the gussets, while the container simultaneously collapses inwardly from the viewpoint of the axis perpendicular to the axis between the gussets 32, 34.

The gussets 32, 34 are positioned in opposed relation to each other on opposite sides of the bag adjacent the shoulder portion, at opposed ends thereof. The gusset portions 32, 34 include lines of weakness to facilitate the collapse of the container adjacent the shoulder portion as the contents are withdrawn. These lines include lines 36 and 38 which may be lines of arcuate cross-section, similar to lines 26, to facilitate flexing.

Each gusset portion 32, 34 is a triangular structure defining three sides, i.e., sides 36, 38 and 40, side 40 of the gusset defining a line which is parallel to the corresponding shoulder edge 42 and preferably, as shown, is coextensive with shoulder edge 42.

Shoulder edge 42 may alternatively define the shape of an enlarged, generally cylindrical section to permit flexing motion of its associated gussets 32, 34 into the outspread relationship of the gussets to the shoulder 20. However, as shown, shoulder edge 42 simply defines an angled line surface to form a relatively sharp corner.

Shoulder 20 also defines a second pair of opposed shoulder edges 44, which may preferably be of relatively enlarged, generally cylindrical section construction, typically of 0.05 to 0.3 inch diameter, extending between the gussets.

The above fold lines of the shoulder edges, the gussets, and elsewhere may specifically be of the cross-sectional shape as defined in U.S. Pat. No. 4,090,541 for desired flexing characteristics.

A pair of opposed lines of flexing weakness 46 is defined in the container of this invention. Lines 46 exhibit an arcuate cross-section to facilitate flexing of the material, the cross-sectional diameter of said lines being preferably from 0.05 to 0.2 inch and specifically about 0.1 inch.

The opposed lines of flexing weakness 46 are positioned on each side of the container in parallel relation to the second pair of shoulder edges 44, being preferably spaced from the shoulder edges in the direction of the flat, sealed end portion by a distance of one sixteenth to one quarter of the length of the container, as measured from the shoulder portion 20 to the flat, sealed end portion 22 and preferably adjacent to but typically about 0.05 to 0.2 inch displaced toward end 24 from a line extending between the apexes 47 of each gusset 32, 34, typically being so displaced about 0.1 inch. For a container which measures about 10 inches between the shoulder edges 42 and the beginning of the flat, sealed end portion 22, opposed lines of flexing weakness 46 may be positioned about 1 or 2 inches from the shoulder edges 44, and specifically about 1.3 inches.

Figure 8:
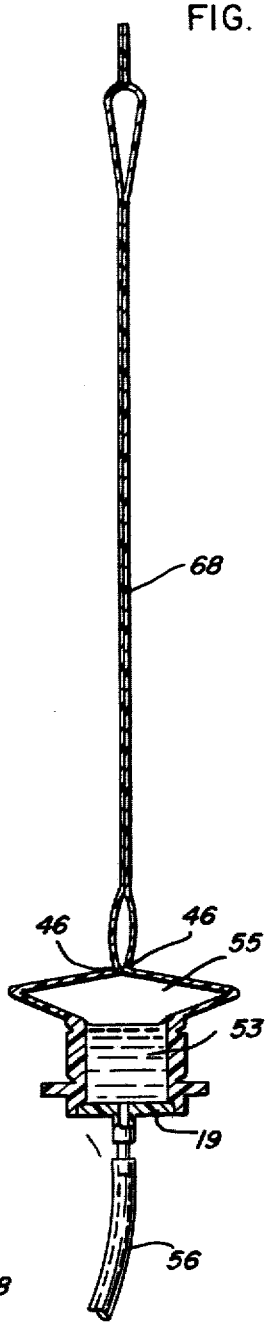
FIG. 8 is a longitudinal sectional view of the container of FIG. 6, showing the container in almost completely drained configuration.

As previously stated, the distance of each shoulder edge 44 and its associated line of flexing weakness 46 on the same side of container 10 must be more than one half, but is preferably substantially less than the spacing between the opposed shoulder edges 44. Specifically, the distance from the center of line of flexing weakness 46 to the center of its associated shoulder edge 44 may be about 1-5/16 inches. On the other hand, the distance between the respective shoulder edges 44 may be about 2-½ inches. As the result of this, as shown in FIG. 8, as the solution container collapses, lines of flexing weakness 46 enter into abutting relationship with each other, while a certain amount of liquid volume 53 and air volume 55 remains in the almost-collapsed container. It is at this point that the flow rate out of the container at essentially unchanged level of suction pressure is substantially diminished, but still remains a positive flow rate of a few cc. per hour, so that the IV needle is not clotted, but at the same time, the patient is not overdosed.

Figure 9:
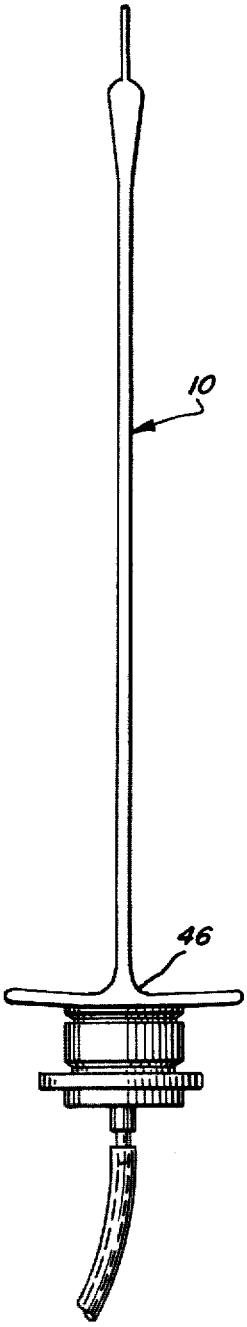
FIG. 9 is an elevational view of the container similar to FIG. 6 showing it in completely drained configuration.

Lines 46 have an inwardly extending cross section, to abut each other as the container collapses, impelled by the liquid suction head in administration set 56, which may be connected at its other end to the venous system of a patient. Also, lines 46 preferably occupy only a central portion of the container, as shown in FIG. 1, being laterally spaced from each apex 47. Ultimately as shown in FIG. 9, the container can completely drain to flat configuration and the flow stops, but, due to the resistance imparted by the abutting, inwardly extending lines of flexing weakness 46, a considerable period of time takes place with low flow rate, sufficient to prevent clotting in the intravenous solution needle, until the supply of solution in the container is exhausted. This gives the nurse added time to check the patient and to replace the container with a new, filled container. If the needle becomes clotted, it must be removed, and a new intravenous puncture must be made with a fresh set.

Preferably, each of the second shoulder edges 44, and its associated parallel line of flexing weakness 46 defines an area 48 between them in the container which is essentially planar in the original, unstressed, as-molded condition of the container. Each planar area 48 may be roughly rectangular in shape in the embodiment as shown, in which the lines of folding weakness 46 are each positioned centrally and transversely on the container, and are of approximately equal length to shoulder edges 44.

Each line 46 is positioned at approximately the same axial position of bag 10 as the apexes 46 of each gusset. Also, preferably, line 46 is of a length corresponding to edge 44 of shoulder 20 so as to define the rectangular planar area 48, and also to define triangular areas 49 on each side of each rectangular area 48, which are each of a shape and area equal to a triangular half 51 of its adjacent gusset 32, 34 as shown for example in FIG. 6. Accordingly, when the container folds, each triangular area 49 can fold up against one half of its adjacent gusset 32, 34 for a flat, efficient fold.

Furthermore, in the collapsed condition, the distance between apexes 47 of the gussets is preferably equal to one half of the circumference of body 10 in the cross section that defines the two apexes 47. This further facilitates flat folding.

Also, it should be noted that line of weakness 46 defines an inwardly extending arc, while the other lines of weakness in the container preferably define outwardly extending arcs.

Referring specifically to FIG. 6, the tapering cross section of the container of this invention, in its as-molded, original, unstressed configuration, can be seen.

Specifically, it can be seen that along the majority of the length of the container, beginning adjacent the shoulder portion, the cross sections (specifically the cross sections of FIGS. 4 and 5) exhibit mutually perpendicular major axes 60 and minor axes 62 in which the major axes are longer than the minor axes. In each cross section, there is seen a pair of opposed, outwardly angled wall portions each of which define the generally acutely-angled apex fold line 26 molded into the bag, which facilitates the flat collapse of the bag. The two apexes 26 are both positioned on major axis 60.

Furthermore, the majority of transverse cross sections exhibits generally planar central areas 68, 70 adjacent the minor transverse axes 62.

At the generally lateral portions of the bag, curved outwardly angled wall portions 72, 72' are defined between the generally planar portions 68, 70 and apexes 26 of the general shape as shown in the drawings.

The curved portions 72, 72' defined between the generally planar portions 68, 70 and the apexes 26 defining the longitudinal edges of the container define a curved surface. The curved surface is of a shape which is definable by a series of diverging, non-intersecting straight lines 74. Also, the curved surfaces of such a shape that straight lines of intersection are formed between curved surfaces 72, 72' and a series of parallel planes 80 positioned parallel to the longitudinal axis 76 of the container and perpendicular to the major transverse axis of the container as illustrated for example by axes 60 of FIGS. 4 and 5. In other words, the planes are parallel to the various axes 62 of the same figures. This particular type of curved surface provides improved collapsibility at low suction pressure for the container into a flat configuration as illustrated by FIG. 9.

The above configuration facilitates the flat collapse of the container which permits, for example, the direct printing of a label on the container prior to filling.

The container of this invention may be filled with parenteral solution and sealed with a conventional sterile seal which is typified by sterile seal 19 as shown, having a removable outer sealing cover if desired, and tubular access member or members 50, generally with a piercable diaphragm within the access member.

A conventional solution set 56, having a piercing spike 54, may penetrate the tubular access member 50 for access to the container, which container may be placed upon a hanger 56, for example an IV pole or the like.

Figure 7:
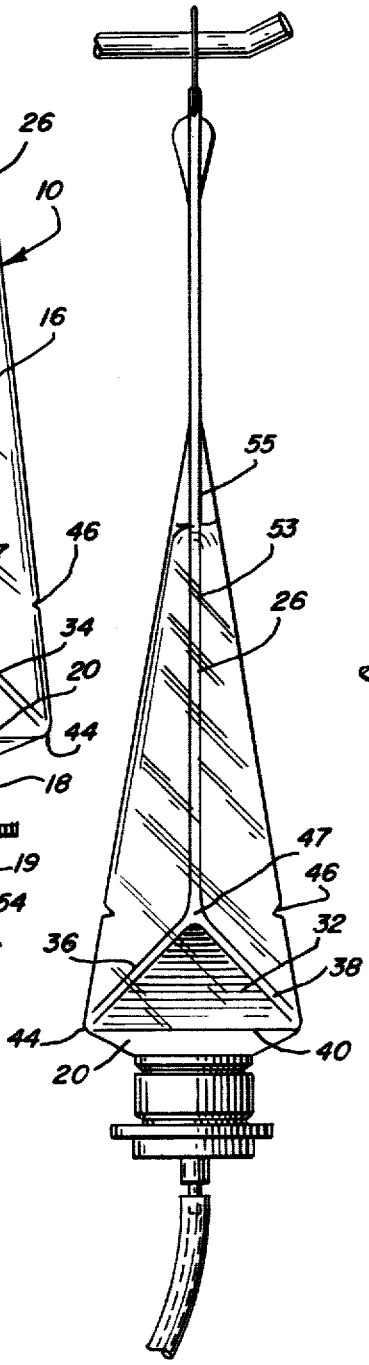
FIG. 7 is a similar elevational view to that of FIG. 6, showing the container in partially drained configuration.

As in conventional IV solution therapy, container 10 may be hung in inverted position, approximately two to three feet or more above the patient, to provide sufficient gravity pressure to administer the solution and also to cause the collapse of the container as the solution is drained. FIG. 7 shows the partial collapse of the container, with the walls of the container flexing into flat configuration along lateral lines of weakness 26.

As the container is more completely drained, and as shown in FIGS. 8 and 9, gussets 32, 34 fold outwardly, while central portions 68 of the bag wall collapse inwardly, with the lines of flexing weakness 36, 38 and shoulder edges 42, 44 flexing to permit this motion.

In other details of structure, the container may be similar to that of the previously cited pending patent application.

The improved mode of collapse of the container of this application permits the use of less air in the container to provide a meniscus to read the remaining liquid level in the container.

The above has been offered for illustrative purposes only, and is not intended to limit the invention of this application, which is as defined in the claims below.

That which is claimed is:

1. In a molded, collapsible solution container, which container defines a chamber-defining body portion wall having an integral neck portion and a shoulder portion at one end thereof, said shoulder portion defining opposed shoulder edges and a pair of opposed lines of flexing weakness defined in said collapsible solution container and exhibiting a cross section which extends inwardly of said container, said opposed lines of flexing weakness being positioned on each side of the container generally parallel relation to said opposed shoulder edges, said opposed lines of flexing weakness being longitudinally spaced from the shoulder edges by a distance which is proportioned to cause said opposed lines of flexing weakness to enter into abutting relationship with one another as the container collapses inwardly about said opposed shoulder edges, whereby the abutting lines of flexing weakness inhibit further collapse of the container under the pressure of suction, to slow the rate of subsequent collapse.

2. The container of claim 1 in which the distance between each opposed shoulder edge and its associated line of flexing weakness is more than one half of but less than the spacing between the opposed shoulder edges.

3. The container of claim 2 in which said distance is no more than 60 percent of the spacing between the opposed shoulder edges.

4. The container of claim 2 in which said opposed lines of flexing weakness define a cross sectional diameter of from 0.05 to 0.2 inch.

5. The container of claim 2 which defines, in its normal, unstressed state, a transverse cross section which tapers from the shoulder portion progressively along a major portion of its length to a flat, sealed end portion at the end of said container opposite to the one end.

6. The container of claim 5 in which the shoulder portion is rectangular in shape, with the wall circumferences of the transverse cross sections of the body portion progressively decreasing in length from adjacent the shoulder portion toward the opposite end.

7. The container of claim 6 in which said flat, sealed end defines a convex, arcuate seal line.

8. In a molded collapsible solution container, which container defines a chamber-defining body portion wall having an integral neck portion and a shoulder portion at one end thereof, and tapering from said shoulder portion progressively along a major portion of its length to a flat, sealed end portion at the end of said container opposite said one end, said container also defining a pair of opposed gusset portions adjacent said shoulder portion at opposite ends of said shoulder portion, said shoulder portion defining opposed shoulder edges extending between said gusset portions, and a pair of opposed lines of flexing weakness defined in said collapsible solution container and exhibiting an arcuate cross section which extends inwardly of said container, said opposed lines of flexing weakness being positioned on each side of the container in generally parallel relation to said opposed shoulder edges, said opposed lines of flexing weakness being longitudinally spaced from the shoulder edges by a distance which is proportioned to cause said opposed lines of flexing weakness to enter into abutting relationship with one another as the container collapses inwardly about said opposed shoulder edges, said distance between each opposed shoulder edge and an associated line of flexing weakness being more than one half of but less than the total spacing between the opposed shoulder edges, whereby the abutting lines of flexing weakness inhibit further collapse of the container under the pressure of suction, to slow their rate of subsequent collapse.

9. The container of claim 8 in which said distance is no more than 60 percent of the spacing between the opposed shoulder edges.

* * * * *